United States Patent [19]

Knowles

[11] Patent Number: 4,888,902

[45] Date of Patent: Dec. 26, 1989

[54] GUN MAGAZINE LOADER

[76] Inventor: Carter L. Knowles, 11105 Lourdes St., Greenville, Miss. 38701

[21] Appl. No.: 360,532

[22] Filed: Jun. 2, 1989

[51] Int. Cl.[4] ..... F42B 39/06

[52] U.S. Cl. ..... 42/90

[58] Field of Search ..... 42/87, 90

[56] References Cited

U.S. PATENT DOCUMENTS

| | | | |
|---|---|---|---|
| 2,403,012 | 7/1946 | McPheters | 42/87 |
| 2,451,521 | 10/1948 | Valum | 42/87 |
| 2,862,324 | 12/1958 | Ball | 42/90 |
| 2,864,193 | 3/1956 | Drew | 42/87 |
| 4,570,371 | 2/1986 | Mears | 42/90 |
| 4,574,511 | 3/1986 | Csongor | 42/87 |
| 4,689,909 | 1/1987 | Howard | 42/87 |
| 4,706,402 | 11/1987 | Csongor | 42/87 |
| 4,719,715 | 1/1988 | Howard | 42/87 |
| 4,827,651 | 5/1989 | Conkey | 42/87 |

*Primary Examiner*—Charles T. Jordan

*Attorney, Agent, or Firm*—Berman, Aisenberg & Platt

[57] ABSTRACT

A device for loading firearm cartridges into a magazine includes a body having a channel open at both ends therethrough for receiving a magazine having an open upper end and a closed lower end. A lever attached to the body may be actuated to exert upward force on the lower end of the magazine, raising it so that the uppermost cartridge in the magazine is biased away from the open upper end of the magazine by a fixed depressor attached to the upper side of the body. Exerting upward force on the lower end of the magazine forces the magazine upwardly so that the fixed biasing means engages an uppermost cartridge in the magazine and holds the uppermost cartridge in a position away from the open upper end of the magazine to allow insertion of a further cartridge into the magazine. When the lever is released, the magazine returns to its initial position and is again raised so that the depressor may engage the uppermost cartridge in the magazine and depress it to enable a further cartridge to be entered into the magazine. A method of using the device is also described.

9 Claims, 2 Drawing Sheets

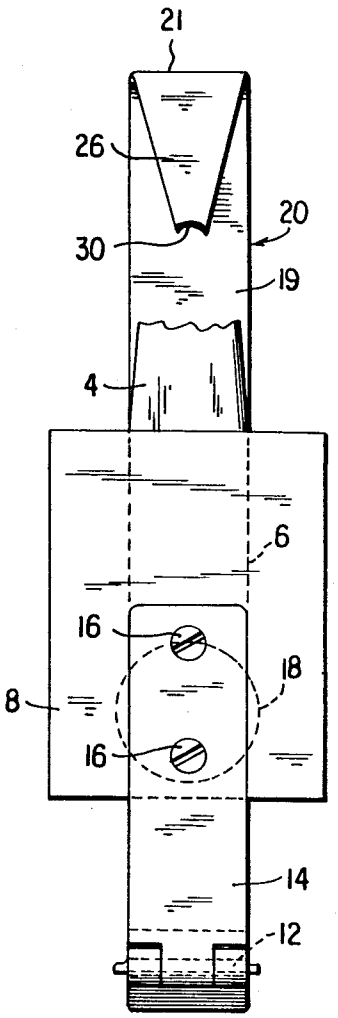
FIG. 2
FIG. 3
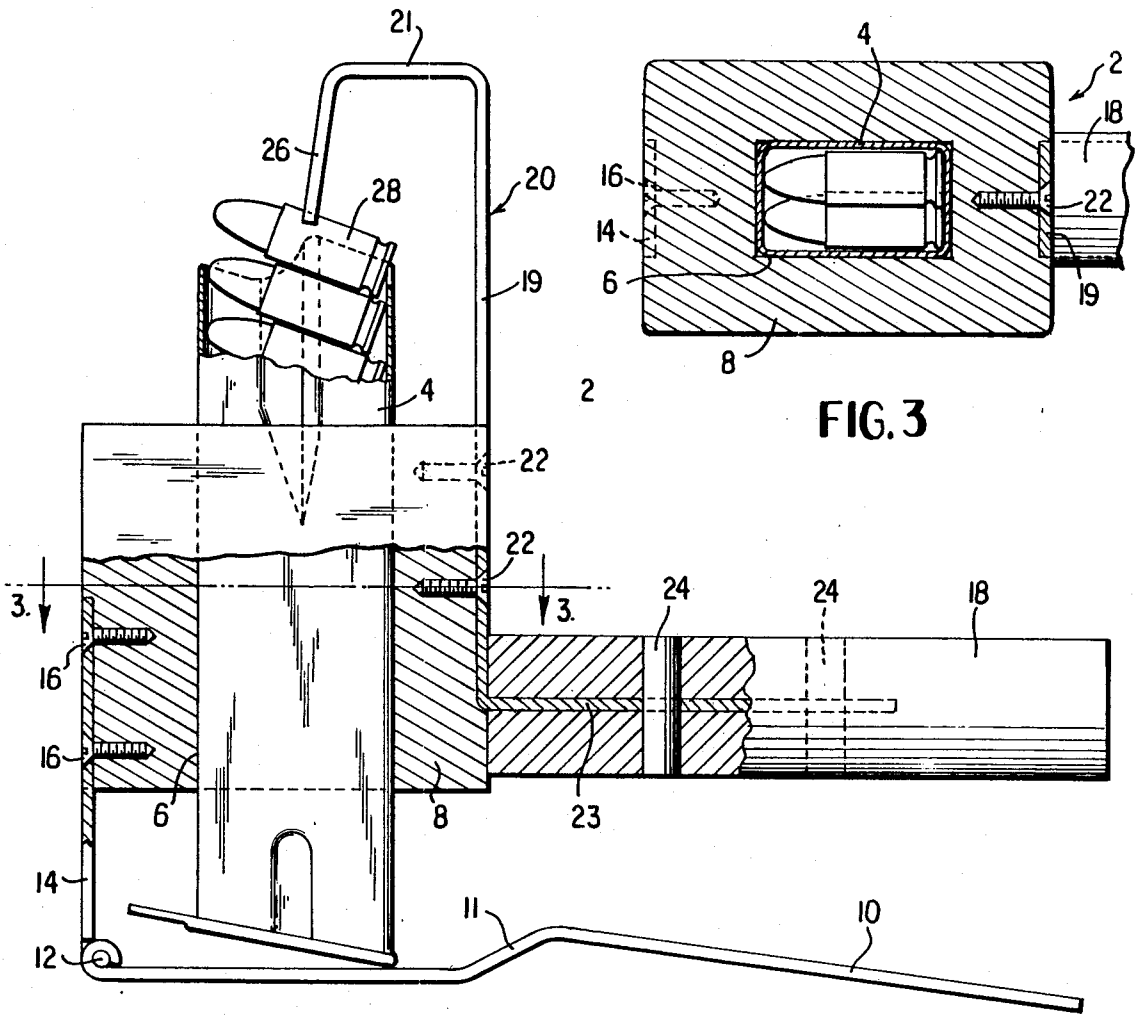
FIG. 1

GUN MAGAZINE LOADER

FIELD OF THE INVENTION

The invention relates to a device for facilitating loading of firearm cartridges into a magazine.

BACKGROUND OF THE INVENTION

Magazines for containing firearm cartridges generally have a strong spring within the magazine allowing each successive cartridge to be positioned at the mouth of the magazine, ready for firing. In order to charge a magazine by hand, cartridges already in the magazine must be pushed downward to make a space for the next cartridge to be inserted. Speed of loading is often necessary, particularly in combat situations, target practice, etc. In other situations also, such as while hunting, time is valuable and a device for rapid magazine charging is useful. With small cartridges, it may be very difficult to charge a magazine quickly using human hands only.

Known magazine loaders have a pivoted or spring member for forcing cartridges down into the magazine to allow a further cartridge to be inserted. The patent to Mears, U.S. Pat. No. 4,570,371, describes a device for loading cartridges into a magazine in which the device is clamped around the top of the magazine and a pivoted handle of the device, having a curved tip forces each cartridge downward into the magazine, thus making space for the next cartridge to be added.

The two patents to Howard, U.S. Pat. Nos. 4,689,909 and 4,719,715, describe a device for attaching to a magazine having either one or two parallel rows of cartridges in which a spring-loaded plunger pushes each cartridge down into the magazine. The two patents to Csongor, U.S. Pat. Nos. 4,574,511 and 4,706,402, each relate to a spring-loaded device for loading a plurality of rounds of ammunition into magazines. The patent to Drew, U.S. Pat. No. 2,864,193, describes a cartridge magazine in which a stop is pushed downwardly, enabling further cartridges to be pushed into the magazine.

In the devices described in each of these patents, a spring or other movable part is used to push the cartridges already in the magazine down further in order to allow entry of a further cartridge.

SUMMARY OF THE INVENTION

The invention is a device for loading firearm cartridges into a magazine. In use, a magazine is positioned in a through channel in a body portion of the loader so that the magazine extends outwardly above and below the through channel. The lower end of the magazine is contacted by a pivoted lever attached to the body portion of the loader and the lever is used to exert an upward force on the lower end of the magazine, raising the magazine to a position where a tip of a fixed rigid member attached to the body portion engages the uppermost cartridge in the magazine and holds it downwardly away from the open upper end of the magazine. Upward pressure on the lever enables the rigid member to force the uppermost cartridge in the magazine downwardly sufficient for the user to insert a further cartridge into the magazine between the uppermost cartridge and the open upper end of the magazine. As the cartridge is loaded into the open upper end of the magazine the upward force on the lower end of the magazine is simultaneously released and the magazine drops to substantially its initial position in the through channel The loading steps are repeated until the magazine contains as many cartridges as required.

It is an object of the invention to provide an improved device for loading a magazine with firearm cartridges.

It is a further object of the invention to provide a device having a fixed rigid means for depressing cartridges already in a magazine while loading further cartridges.

It is another object of the invention to provide an improved method for loading cartridges into a magazine for firearm cartridges.

BRIEF DESCRIPTION OF THE DRAWINGS

FIG. 1 is a side elevational view, partly broken away, of a magazine loader of the invention, showing a magazine in the through channel of the device.

FIG. 2 is a left side elevational view of the device of FIG. 1.

FIG. 3 is a cross-sectional view taken on line 3-3 of FIG. 1.

DETAILED DESCRIPTION OF THE INVENTION

The invention provides a simple device and method for loading cartridges into a magazine. The device may be made in a range of sizes to accommodate a magazine of any known size. The magazine loader of the invention employs a fixed member to depress the cartridges in a magazine while the magazine is raised upwardly by pressure exerted on the closed lower end of the magazine by a pivoted lever which is gripped together with the handle of the device, by a user. When the user grips or squeezes the handle and the lever together, the magazine is raised upwardly so that the fixed member engages the uppermost cartridge in the magazine, and as the magazine is raised further, the fixed member pushes the uppermost cartridge downward in the magazine, away from the open upper end of the magazine, leaving space for insertion of a further cartridge on top of the one or more cartridges already in the magazine. The device may be used with any type of magazine.

With reference to the Figures, in which like numerals represent like parts, FIGS. 1 to 5 show a device of the invention used with a staggered column magazine. A single column magazine may be loaded similarly.

Figure 5:
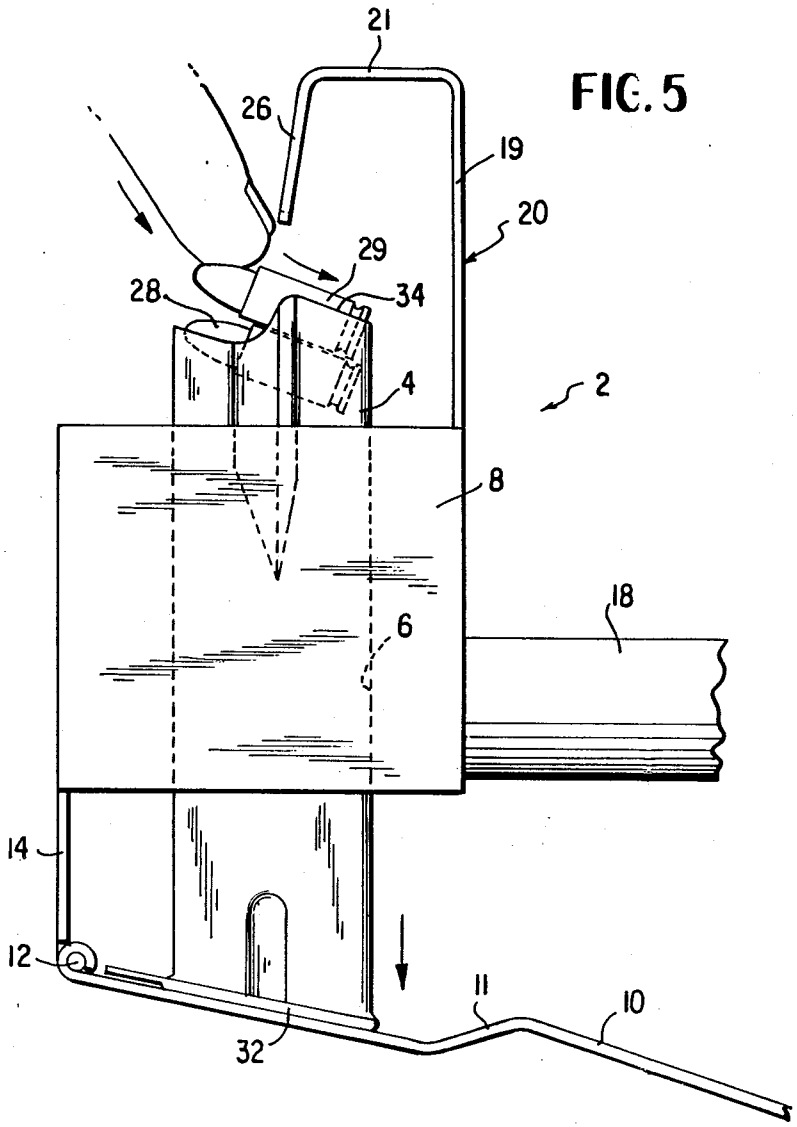
FIG. 5 is a side elevational view showing the position of the magazine after a cartridge has been inserted.

FIG. 1 shows magazine loader 2 having magazine 4 inserted in channel 6 through body portion 8 of device 2. Magazine 4 extends above and below channel 6 when magazine 4 is positioned in device 2. Device 2 includes lever 10 pivoted at hinge 12 to member 14 which is attached by screws 16, or other fasteners, to body 8. In use, lever 10 is gripped together with handle 18 to raise magazine 4 to the position shown in FIG. 4, and lever 10 is released after a cartridge has been inserted, as shown in FIG. 5. Lever 10 is preferably bent at intermediate portion 11, as shown in FIGS. 1 and 2, 4 and 5, to facilitate gripping together with handle 18.

Member 20, which depresses the cartridges in the magazine, is attached to body 8 by screws 22, or other suitable fasteners. Member 20 may bend at right angles away from body 8 so that portion 23 anchors handle 18 by rivets 24, or other appropriate fasteners.

Member 20 is attached to, and extends vertically upward from, body 8. The vertical portion 19 of member 20 is joined to a substantially horizontal portion 21 which in turn is joined to a downwardly extending depressor portion 26. Depressor portion 26 extends downwardly at an angle of about 95 degrees to horizontal portion 21 so that depressor portion 26 meets uppermost cartridge 28 substantially in the center of the cartridge case. Depressor 26 preferably has a curved tip 30 which engages the curved surface of uppermost cartridge 28 in magazine 4. A suitable radius of curvature of curved tip 30 will be apparent to one skilled in the art.

Figure 4:
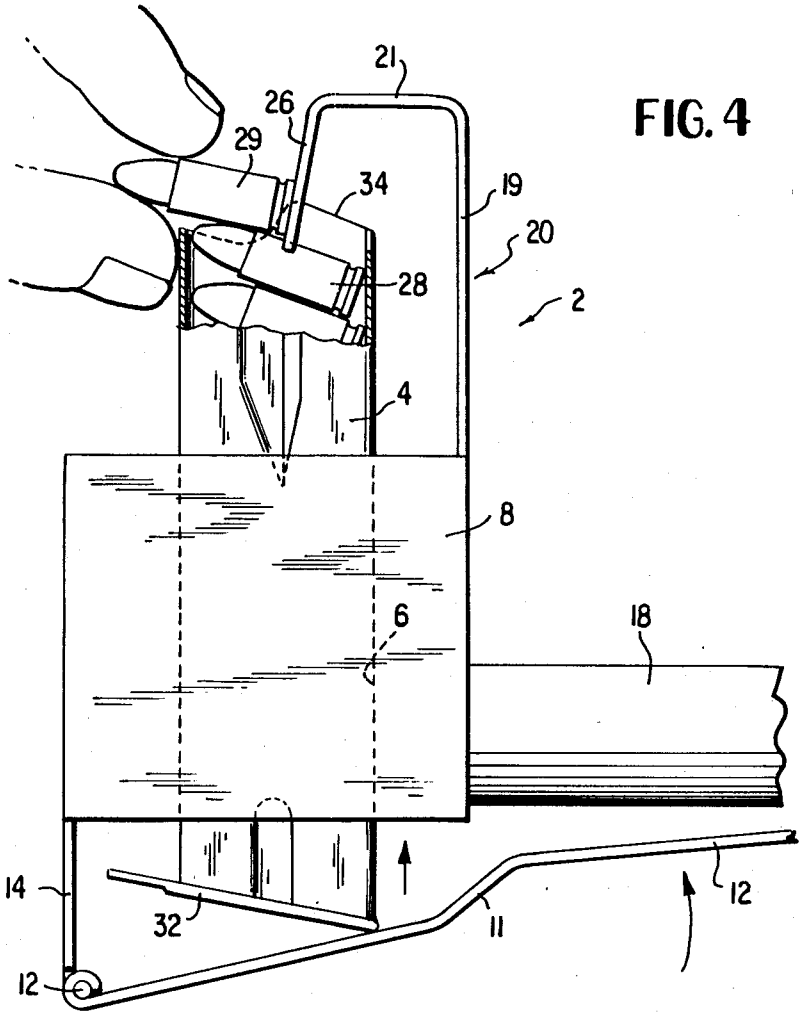
FIG. 4 is a side elevational view showing the raised position of the magazine when a cartridge is being inserted.

FIGS. 4 and 5 show the operation of the device. Magazine 4 is inserted in channel 6 so that both the open upper end and closed lower end of magazine 4 extend outwardly of channel 6. The closed lower end 32 of magazine 4 engages lever 10. Lever 10 is squeezed together with handle 18, and magazine 4 is raised to the position shown in FIG. 4 with depressor 26 holding uppermost cartridge 28 downwardly away from upper open end 34 of magazine 4. With cartridge 28 held away from upper open end 34, cartridge 29 is inserted horizontally as far as the depressor 26 and then the user's grip is released and magazine 4 drops to the position shown in FIG. 5 while the user pushes cartridge 29 into position on top of cartridge 28. Thus, the magazine returns to its initial position ready to be raised again, through the channel, so that the new uppermost cartridge is held by depressor 26 away from upper open end 34 to facilitate entry of the next cartridge.

The device may be made of any suitable materials. Members 10, 14 and 20 are appropriately made of iron or steel. Body 8 may be made of plastic, metal, wood or other suitable material. Dimensions may be chosen according to the size of magazine being used. Channel 8 surrounds magazine 4 with sufficient tolerance to allow magazine 4 to move easily in and through channel 8. For a 9 mm. cartridge, channel 8 may appropriately be about 1 7/16 in. long by 13/16 in. wide to receive a staggered column magazine. Member 20 may extend to 2 ¼ in. above body 8 and depressor 26 may be 1 in. in length and ¾ in. in width across portion 21. A tolerance of 1/16 in. around the magazine in the channel is suitable. Other dimensions will be apparent to those skilled in the art.

The dimensions of depressor 26 are selected so that tip 30 and the lower portion of depressor 26 can enter the open upper end of magazine 4 when the cartridges are depressed in the magazine, as shown in FIG. 4. Therefore, the lower end of depressor 26 must be narrower than the width of the opening of upper end 34 of magazine 4.

While the invention has been described above with respect to certain embodiments thereof, it will be appreciated that variations and modifications may be made within the spirit and scope of the invention.

What is claimed is:

1. A device for loading firearm cartridges into a magazine comprising:

body means including a channel therethrough open at both ends for receiving a magazine having an open upper end and a closed lower end;

means attached to said body means for exerting upward force on the lower end of the magazine;

fixed rigid means attached to said body means for biasing cartridges contained in the magazine away from the open upper end of the magazine, whereby exerting upward force on the lower end of the magazine forces the magazine upwardly whereby said fixed biasing means engages an uppermost cartridge in said magazine and holds said uppermost cartridge in position away from the open upper end of the magazine for facilitating insertion of a further cartridge into the magazine on top of said uppermost cartridge.

2. A device according to claim 1 wherein said means for exerting upward force comprises a pivoted lever.

3. A device according to claim 2 further comprising a handle extending from said body means substantially perpendicularly to the longitudinal axis of a magazine positioned in said channel.

4. A device according to claim 3 wherein said lever is pivoted to a position substantially adjacent said handle when a magazine in the channel is in the raised position.

5. A device according to claim 4 wherein said lever extends substantially perpendicularly to the longitudinal axis of a magazine positioned in the channel.

6. A device according to claim 1 wherein the fixed rigid means comprises elongated means substantially parallel to a longitudinal axis of a magazine in the channel for engaging the uppermost cartridge.

7. A device according to claim 6 wherein the elongated means is sized to enter the open upper end of the magazine when the magazine is in the raised position for insertion of a cartridge.

8. A device according to claim 7 wherein the elongated means further comprises curved end means for engaging and substantially conforming to a portion of a circumference of the uppermost cartridge.

9. A method for loading cartridges for a firearm in a magazine having an open upper end and a closed lower end comprising:

(a) positioning the magazine in a through channel in a body portion of a magazine loader whereby the magazine extends outwardly o both ends of the channel;

(b) exerting an upward force on the lower end of the magazine thereby raising the magazine to a position whereby a tip of a rigid fixed means for biasing cartridges engages an uppermost cartridge in the magazine;

(c) exerting further upward force on the lower end of the magazine to depress said uppermost cartridge and hold it away from the open upper end of the magazine;

(d) loading a cartridge into the open upper end of the magazine on top of the uppermost cartridge while simultaneously releasing the upward force on the lower end of the magazine, whereby the magazine drops to substantially its initial position in the through channel;

(e) repeating steps (b) through (d) for each cartridge to be loaded.

* * * * *